United States Patent [19]

Syred et al.

[11] Patent Number: 4,584,948

[45] Date of Patent: Apr. 29, 1986

[54] COMBUSTORS

[75] Inventors: Nicholas Syred, Cardiff; Martin Biffin, Pontyclun; Timothy C. Claypole, Dinas Powys, all of Wales

[73] Assignee: Coal Industry (Patents) Limited, London, England

[21] Appl. No.: 678,220

[22] Filed: Dec. 4, 1984

[30] Foreign Application Priority Data

Dec. 23, 1983 [GB] United Kingdom ..... 8334332

[51] Int. Cl.[4] ..... F23D 1/02

[52] U.S. Cl. ..... 110/264; 110/265; 110/266; 431/173

[58] Field of Search ..... 110/264, 265, 347, 266; 431/10, 165, 173, 352

[56] References Cited

U.S. PATENT DOCUMENTS

| | | | |
|---|---|---|---|
| 2,800,091 | 7/1957 | Lotz et al. | 110/264 |
| 2,808,012 | 10/1957 | Schindler | 110/264 |
| 4,002,127 | 1/1977 | Angus | 110/264 X |
| 4,144,019 | 3/1979 | Lyshkow et al. | 110/264 X |
| 4,146,359 | 3/1979 | Lumpkin et al. | 110/264 X |
| 4,351,251 | 9/1982 | Brashears | 110/264 X |

*Primary Examiner*—Edward G. Favors

*Attorney, Agent, or Firm*—Stevens, Davis, Miller & Mosher

[57] ABSTRACT

A combustor for burning a feedstock includes a cylindrical body having a tangential feedstock inlet and an exhaust outlet. A catchment chamber of hollow cylindrical form intersects the wall of the body and opens into the cavity to provide a common boundary. Swirling or vortical flow is created in the cavity and a secondary vortex is generated and driven within the chamber by the main flow. In operation contaminant matter is sheared off from the flow in the body into the chamber and is entrapped by the secondary vortex from which it is precipitated, there being no net gas flow across the boundary.

56 Claims, 13 Drawing Figures

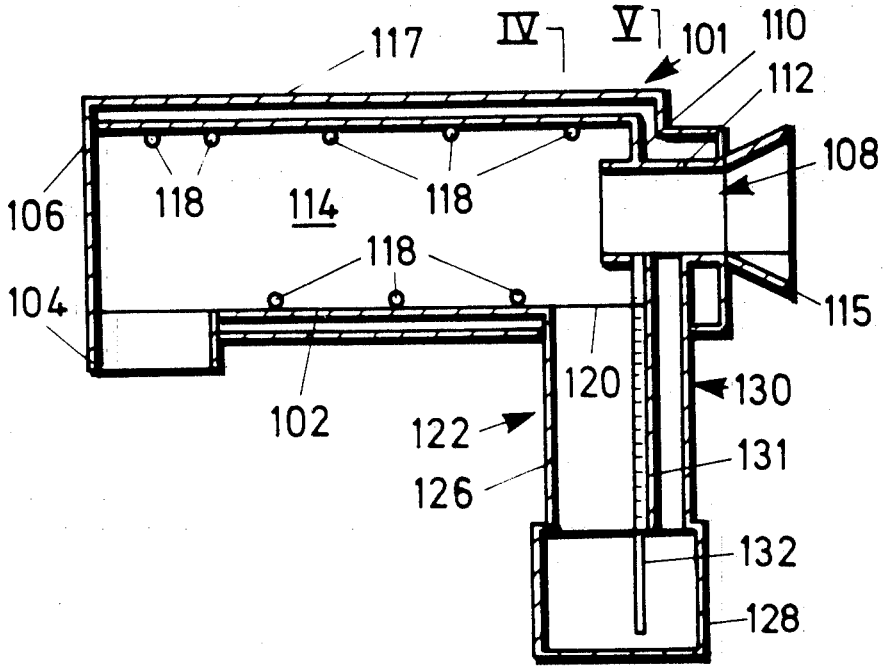
FIG.3 IV V
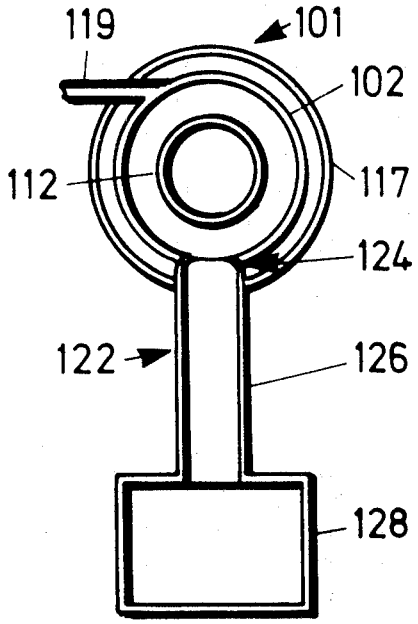
FIG.4

COMBUSTORS

This invention concerns improvements in or relating to combustors.

In particular, the present invention has reference to combustors which employ swirl or vortical flow for the combustion of a feedstock which may be solid, liquid, gaseous or a combination thereof. Combustors of this general type are known, but one of the problems attendant upon their usage is that of emissions, especially when solids materials are undergoing combustion. Increasing efforts are being made to improve the quality of the environment and to this end conventional combustors of this type are under investigation with a view to enhancing performance to suppress emission and also to widen their scope of application within industry. For example, such improved combustors could be employed in boiler retrofit applications thus providing a relatively clean hot gas for the tube passes and thereby obviating the problems of fouling by entrained particulates or other contaminant material.

An object of the present invention is therefore to provide an improved combustor having a facility to remove contaminant material from the combustion gas stream prior to its egress from the combustor.

According to the invention a combustor comprises a hollow circular sectioned body within which combustion is to take place in a swirl or vortical flow, the body having an inlet at or towards one end thereof for the introduction of a feedstock, an exhaust outlet in the body, at least one port in the body for the entry of a combustion promoting gas, the port being so disposed as to generate in use a swirl or vortical flow within the body, and a catchment chamber intersecting and opening into the body along part of its length in such a manner that in use a secondary vortex is established in the chamber, in use contaminant matter arising from the combustion of the feedstock passing from the body into the chamber precipitating therein for removal therefrom. The catchment chamber opening into the body along part of its length may do so along the side of the body or at one end thereof. Conveniently, the secondary vortex may be established in the chamber in the absence of any gas flow across the common boundary between the body and the chamber, the chamber accordingly being closed or sealable at each end. Alternatively, in use some net gas flow across the common boundary may be allowed to occur by way of a bleed from the catchment chamber, the bled flow being passed to a suitable cleaning device.

The body may conveniently be cylindrical and the inlet may be disposed axially or tangentially in relation thereto. Alternatively, the body may be frusto-conical or may have a primary frusto-conical section contiguous with a secondary cylindrical section.

The exhaust outlet may be arranged on the axis of the body and may be constituted by a tubular member protruding into the body through one end thereof. The exhaust outlet may be located at the end of the body remote from the inlet or may be disposed adjacent the inlet. In this latter case, the inlet is arranged in the wall of the body to communicate with the annulus defined between the tubular member of the outlet and said wall.

Conveniently a plurality of ports is provided, each port being arranged such that flow therethrough emerges tangentially into the body. Additionally, the ports may be angularly orientated so as in use to give swirl or vortical flow towards one end of the body. The orientation of the ports may advantageously be towards the inlet for the feedstock.

The catchment chamber may be circular section, for example in the form of a cylinder the axis of which is arranged parallel to that of the body. The wall of such a cylindrical chamber or a part of the wall is relieved part circumferentially for intersection and registration with a correspondingly relieved portion of the body whereby in cross-section the walls of the body and the chamber overlap in the manner of intersecting circles to provide the common boundary.

The catchment chamber may be located at or near the exhaust outlet or may be disposed at the most appropriate point along the length of the body to achieve the most effective catchment of contaminants following complete or substantially complete combustion of the feedstock. The catchment chamber may be located at the end of the body remote from the exhaust outlet. More than one catchment chamber may be provided along the length of the body.

In an alternative embodiment, the catchment chamber may be curvilinear with a part circular portion leading to a rectilinear portion. The part circular portion is relieved to provide an opening for registration with a complementary opening in the wall of the body thereby providing the common boundary between the body and the chamber.

A further catchment chamber may be arranged in association with the exhaust outlet. In the case where the outlet is formed of the tubular member, the further catchment chamber intersects and opens into the member, the chamber being of similar type to those already described. The further catchment chamber may have a common bounding wall with the catchment chamber associated with the body of the combustor.

The catchment chamber may conveniently be provided with a receptacle for contaminants precipitated by the secondary vortex or may alternatively have a discharge means, for example in the form of a worm extractor in the case of solid contaminants.

The body of the combustor may be refractory lined or may be water cooled, an appropriate jacket being provided for this purpose. In operation the body of the combustor may be arranged horizontally or vertically.

By way of example only, several embodiments of combustor according to the invention are described below with reference to the accompanying drawings in which:

FIG. 3 is a diagrammatic side sectional view of a second embodiment;

FIG. 4 is a cross-sectional view on the line IV—IV of FIG. 3;

Figure 1:
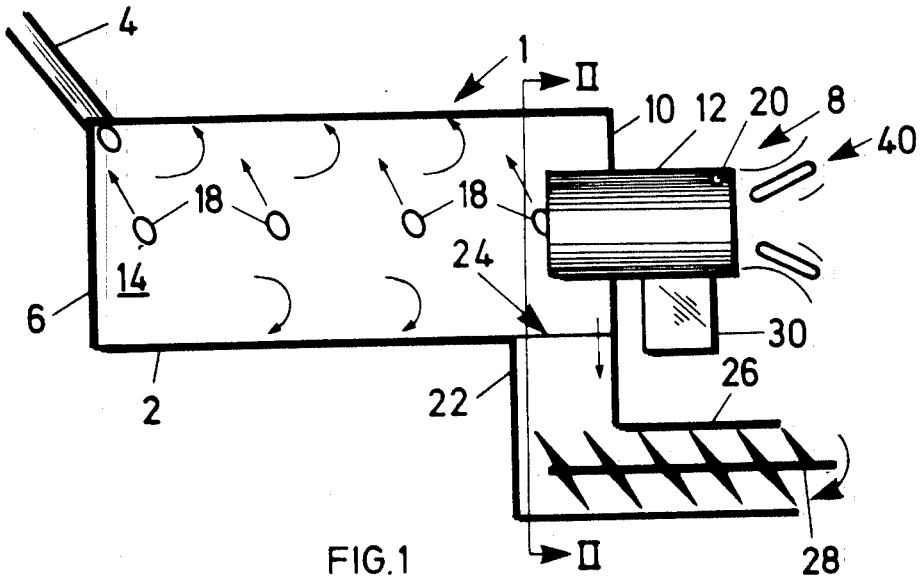
FIG. 1 is a diagrammatic side sectional view of a first embodiment.
Figure 2:
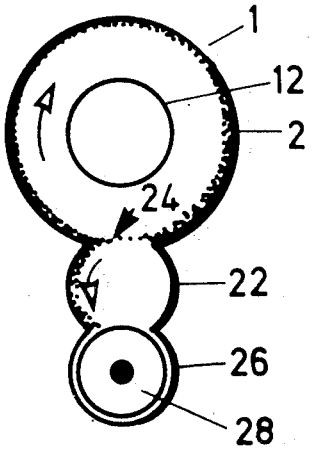
FIG. 2 is a cross-sectional view on the line II—II in FIG. 1.

Referring to FIGS. 1 and 2, a combustor 1 includes a hollow cylindrical body 2 arranged horizontally and having a tangential feedstock inlet 4 at one end 6 thereof, the inlet 4 being angularly orientated away from the end 6. An exhaust outlet 8 is provided at the other end 10 of the body 2 and is in the form of a tubular member 12 penetrating end 10 and extending part way into the cavity 14 of the body 2.

Four equispaced tangential inlet ports 18 are formed in and along the wall of body 2 and are angularly orientated towards end 6. The ports 18 being provided for the introduction of a combustion promoting gas, for example air. A further inlet port 20 is provided in the tubular member 12. A catchment chamber 22 of hollow cylindrical form is arranged with its axis parallel to that of the body 2 and opens into the body adjacent end 10 to give a common open boundary at 24. The walls of the chamber 22 and body 2 intersect one another as can more easily be seen from FIG. 2, in the manner of intersecting circles, the walls being relieved to conjoin one another at the boundary 24. The base of the chamber 22 communicates in a similar way with a cylindrical housing 26 in which is arranged a worm extractor 28. A further catchment chamber 30 is provided in a similar manner in association with the tubular member 12, the base (not shown) of the chamber 30 being closed.

In operation, a feedstock which may be solid, liquid, gaseous or a combination thereof is introduced through inlet 4. For the purposes of this example, the feedstock is a solid particulate combustible material such as milled coal. Conveniently the coal is transported through the inlet 4 by primary air and upon entering the cavity 14 of body 2 is caused to follow a swirling or vortical path therewithin. For initiating combustion, preheating is necessary and may be effected either by the provision of an oil burner producing hot gas for introduction into the body or by the use of a start-up gas which is burnt within the body. In this example, a start-up gas is introduced through ports 18 and ignited in order to set the right temperature level for combustion of the coal; thereafter the start-up gas flow is stopped and air is passed through the ports 18, coal being introduced into the combustor as aforesaid. The incoming secondary air emerging from ports 18 assists in creating swirl or vortical conditions in the body 2 for combustion of the coal particles. The coal particles are gradually burnt in their path within the cavity 14, gaseous and solid combustion products of combustion being generated in the process. The coal particles are burnt rich in the cavity 14, e.g., less than 60% stoichiometric, and inlet velocities may be of the order of 50 m/s to reduce depositions and to assist removal of particular residue. The solid products, i.e., ash, are carried by the swirling or vortical flow towards the end 10. The ash particles tend to be entrained in that swirling or vortical flow at the periphery of the body 2 adjacent the wall thereof in a boundary layer.

Upon start-up of the combustor 1, by virtue of the swirling or vortical flow in cavity 14, a secondary vortex is created and driven in the catchment chamber 22 by the main vortex or swirl within body 2. After the initial creation of this secondary vortex, no net gas flow across boundary 24 occurs. Once the entrained ash reaches the boundary 24, the particles are sheared off into chamber 22 wherein they are entrapped by the secondary vortex and precipitate out for removal by extractor 28 through housing 26.

Gaseous or volatile products of coal combustion pass through the tubular member 12 of outlet 8 and undergo combustion, tertiary air being introduced through port 20 for this purpose. Any particulates still entrained in the gases flowing through the tubular member 12 are sheared off into the further catchment chamber 30 in which a vortex is driven by the vortical or swirling flow of gases within the tubular member, there being no net gas flow from the tubular member 12 into the chamber 30 following creation of the secondary vortex. The particles so removed from the exhausting gases precipitate within the chamber 30 for extraction and disposal.

As can be seen in FIG. 1, at 40, the volatiles and any other material are burnt in a long luminous flame at the outlet 10.

It is to be understood that the combustor of the present invention may be used in a non-slagging mode or a slagging mode. In the latter case, temperatures in excess of 1600° C. are attained within the body of the combustor and liquid slag is sheared off into the catchment chamber(s).

By virtue of the provision of the catchment chambers 22 and 30, particulates formed during the combustion process are substantially removed from the exhausting gas stream, thereby ensuring a substantially clear flame at the outlet. Emissions of particulates are therefore suppressed.

Referring now to FIGS. 3 to 6 a combustor 101 comprises a horizontally orientated hollow cylindrical body 102 having a tangential feedstock inlet 104 at one end 106 of the body 102 and an axial outlet 108 at the other end 110 thereof. A tubular member 112 constitutes the outlet 108 and protrudes part way into the cavity 114 of the body 102. In an alternative embodiment (not shown), the member 112 protrudes further into the cavity 114 than is shown in FIG. 3. A detachable exhaust nozzle 115 of frusto-conical form is attached externally to the member 112. A cooling jacket 117 is provided for the body 102 and the member 112, suitable cooling fluid supply and return lines (not shown) for the jacket 117 being provided. Alternatively, the body 102 may be refractory lined thereby obviating the need for cooling.

A plurality of tangential inlet ports 118 are provided in spaced relation along the length of the body 102 for the introduction of combustion promoting gas through lines 119 (FIG. 6) which are angularly orientated towards the end 106, the angular orientation being for example 30°. In an alternative embodiment (not shown), the tangential feedstock inlet 104 may be formed in a similar manner to the ports 118 which may be seven in number at the top and the bottom of the body 102, the inlet being disposed near end 106 and incorporating an ejector which assists in balancing pressure in the body 102.

Figure 5:
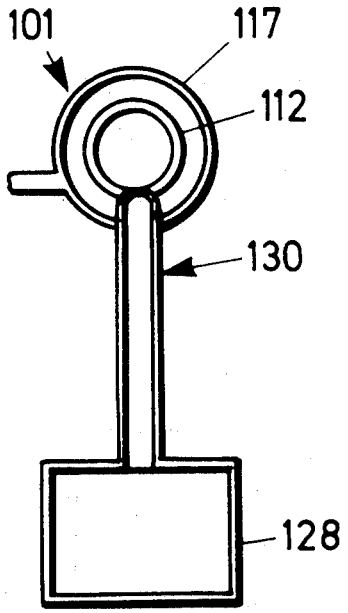
FIG. 5 is a cross-sectional view on the line V—V of FIG. 3.
Figure 6:
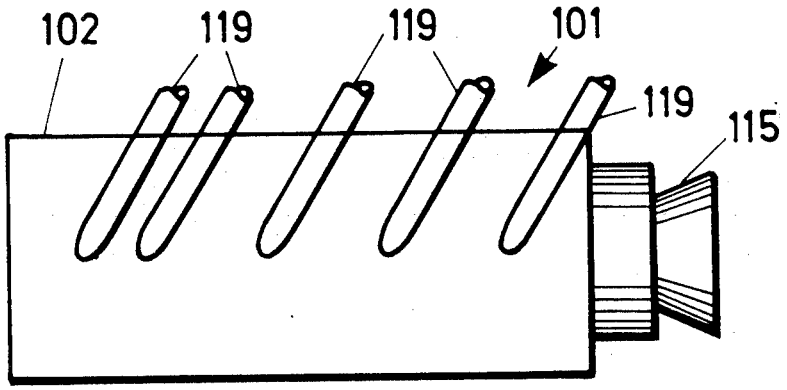
FIG. 6 is an external plan view of the second embodiment.

Adjacent the end 110, the body 102 is relieved part circumferentially to provide an opening 120 with which registers in communicating fashion a catchment chamber 122 which is correspondingly relieved to provide access between the interior of the chamber 122 and the cavity 114. The chamber 122 is of curvilinear form having a part circular portion 124, which intersects the wall of the body 102, leading to a linear portion 126 provided with a particle collection box 128 at the base thereof. The portion 124 intersects the curved wall of the body 102 in the manner of intersecting circles and provides a radiused inlet section to the chamber 122. A further catchment chamber 130 of similar form, see particularly FIG. 5, is associated with the tubular member 112 and is disposed adjacent chamber 122 with a common wall 131 therebetween. The box 128 is also common to both catchment chambers and the wall 131 is provided with a downward extension 132 depending at least part way into the box 128.

In operation, natural gas and air are introduced at a velocity of about 50 m/s through at least some of the ports 118 and ignited to bring the combustor 101 up to a temperature at which the intended feedstock can burn rich, e.g., less than 60% stoichiometric, the burning mixture creating swirl or vortical flow conditions within the cavity 114. In an alternative, an oil burner may be employed to generate a hot gas for start-up purposes. At the same time secondary vorticles are created and driven in chambers 122 and 130 by the main flow in body 102, thereafter no net gas flow occurring between cavity 114 and the chambers 122 and 130. Upon attainment of the requisite temperature level, a solid particulate feedstock, for example milled coal or coke breeze, is introduced through the tangential inlet 103 and is caused to follow a swirling or vortical path within the cavity 114, air passing through ports 118 promoting combustion of the feedstock. The feedstock particles are burnt during their swirling or vortical path(s) in cavity 114, both gaseous and solid products of combustion being thereby generated. The solid particles of combustion, i.e., ash, tend to be carried in the gases in a boundary layer adjacent the wall of body 102. Upon encountering the opening 120, the particles are sheared off into the portion 124 of the chamber 122 wherein they are captured by the secondary vortex and precipitate into the portion 126 and are deposited in the box 128 for removal. The combustion gases pass into the tubular member 112 and any particles remaining entrained therein are sheared off into chamber 130 in a similar manner as for chamber 122; the volatiles in the exhaust gases are burnt therein and issue in a flame through the exhaust nozzle 115. The particles entrapped by the secondary vortex in chamber 130 precipitate out and descend into the box 128, the extension 132 preventing any access between the chambers 122 and 130. As with the first embodiment, the combustor 101 provides a system in which particles which would otherwise contaminate the exhausting gases are removed therefrom prior to their egress from the combustor. The ash particles so removed may be deposited into a water bath for subsequent disposal.

Figure 7:
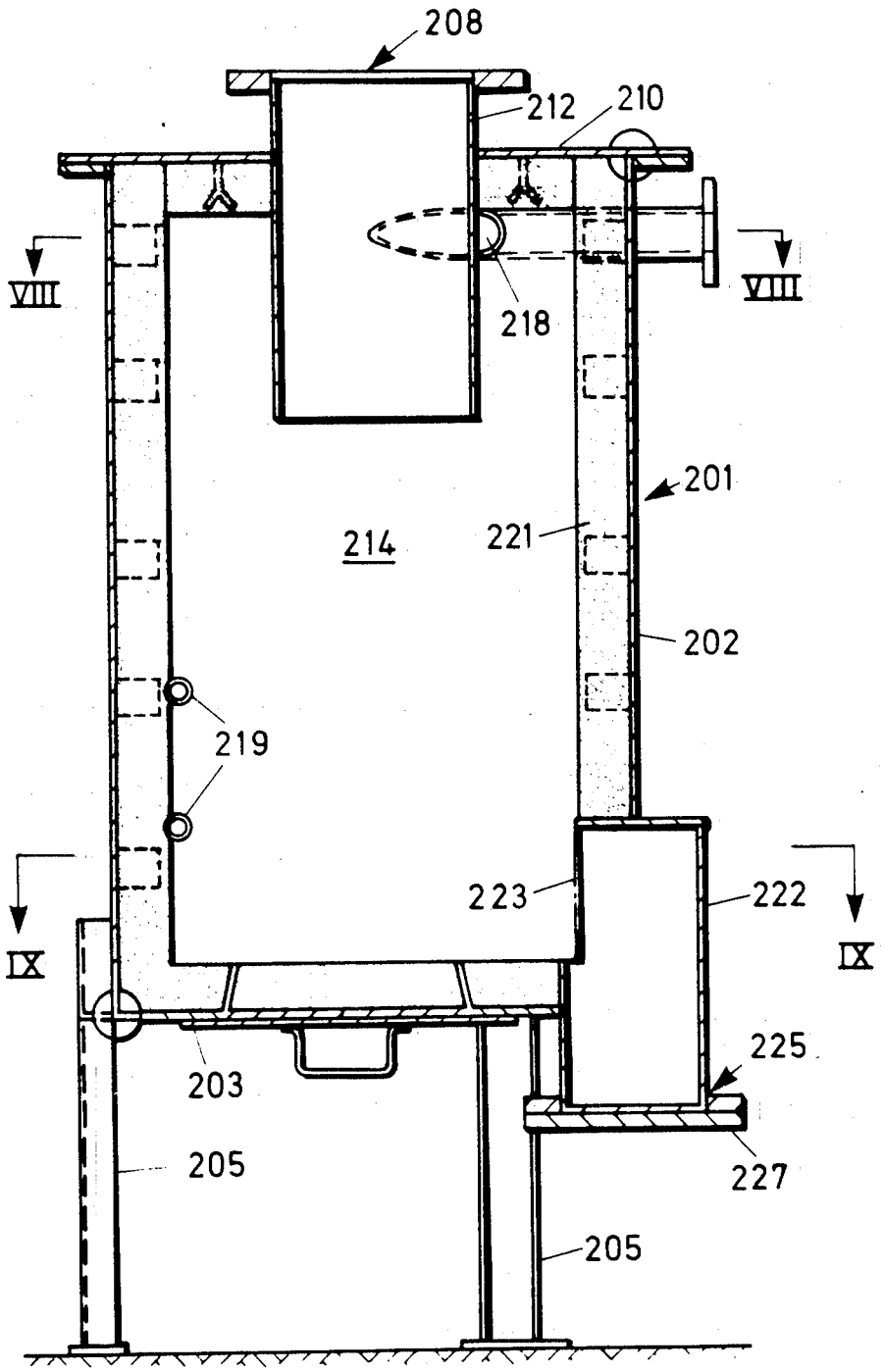
FIG. 7 is a vertical section through a third embodiment.
Figure 8:
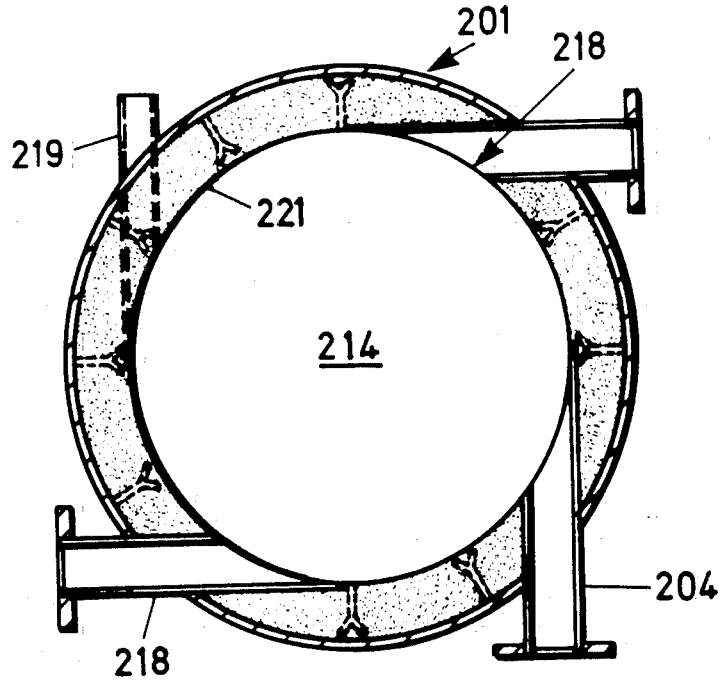
FIG. 8 is a cross-sectional view on the line VIII—VIII of FIG. 7.
Figure 9:
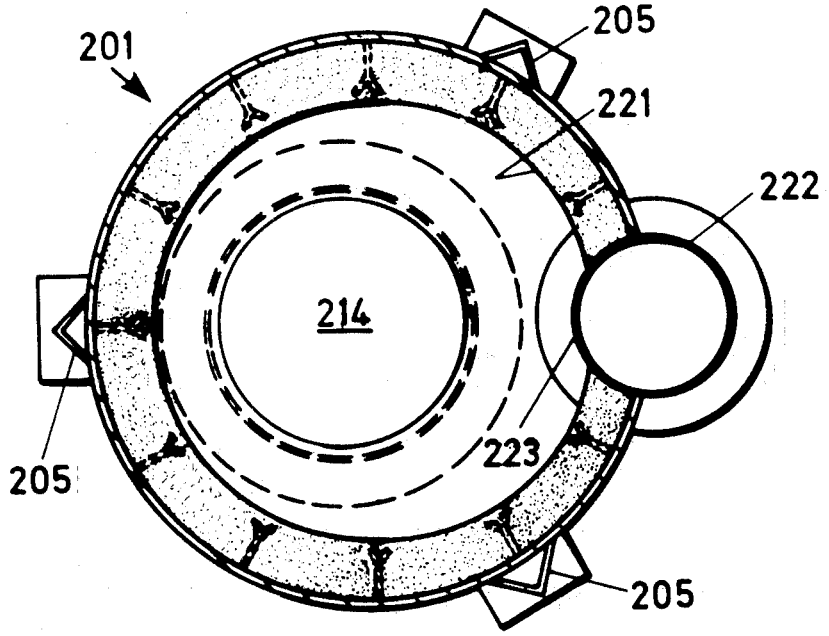
FIG. 9 is a cross-sectional view on the line IX—IX of FIG. 7.
Figure 10:
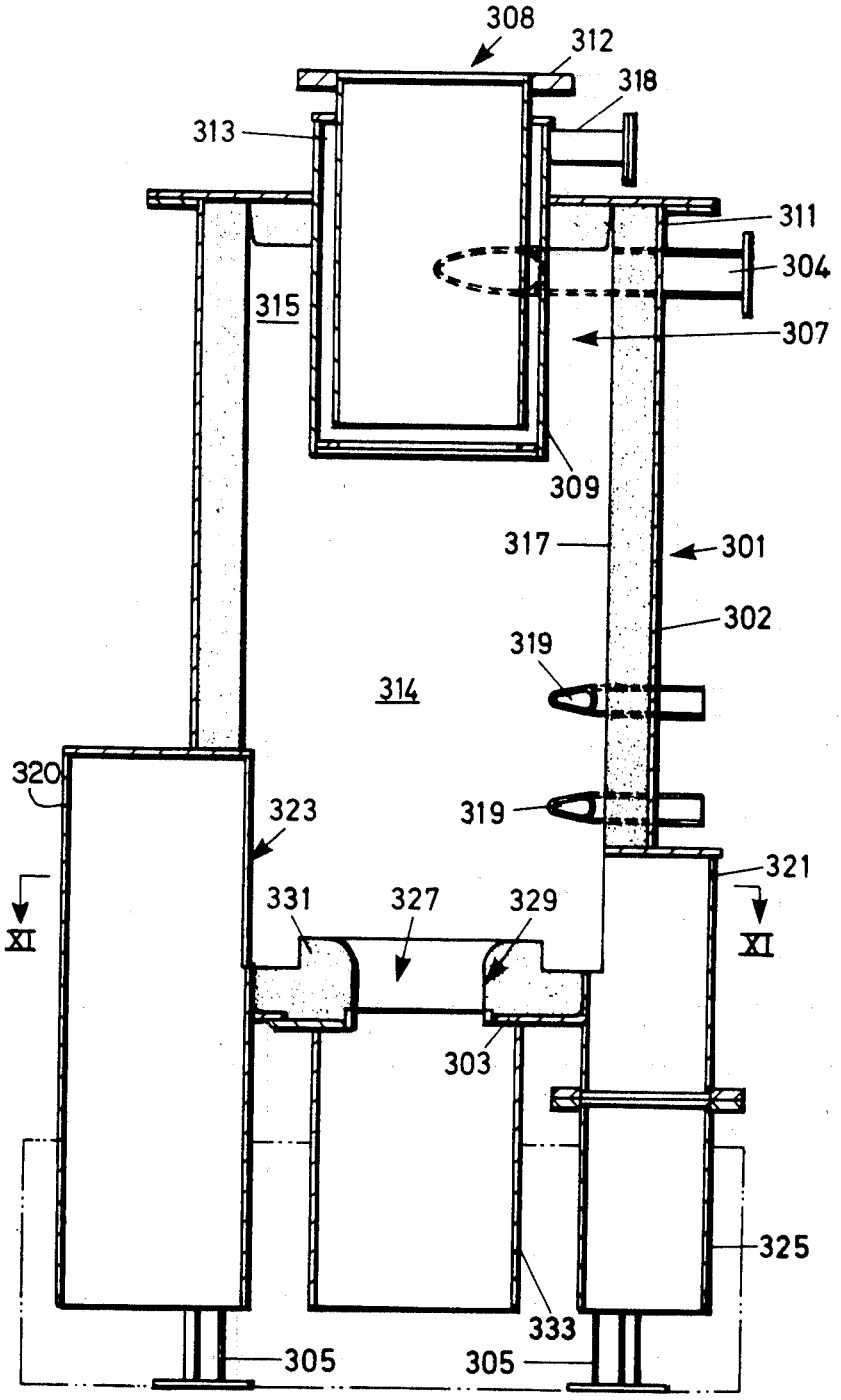
FIG. 10 is a vertical section through a fourth embodiment.

Referring now to FIGS. 7, 8 and 9, a third embodiment of combustor 201 is illustrated and comprises a vertically arranged cylindrical body 202 having a base end 203 mounted on support legs 205. The body 202 has a tangential feedstock inlet 204 (FIG. 8) located at end 210 remote from base end 203. An exhaust outlet 208 is constituted by a flanged tubular member 212 extending part way into cavity 214 of the body 202. Tangential inlet ports 218 are circumferentially offset from inlet 204 and are arranged at the same level. Further inlet ports 219 are provided in the wall of the body 202 which is refractory lined as at 221.

Adjacent the base end 203, the wall of body 202 is relieved at 223 to provide an opening communicating with a catchment chamber 222 which is of cylindrical form with its axis parallel with that of the body 202. The corresponding part of the wall of the chamber 222 is similarly relieved such that the walls of the body and the chamber intersect or overlap in the manner of intersecting circles, as can more particularly be seen in FIG. 9. The base 225 of chamber 222 is flanged and a closure plate 227 is attached thereto.

In operation, a gaseous feedstock, for example waste gas from a smokeless fuel production facility is fed tangentially through inlet 204 into the cavity 214 of body 202, air also being introduced through ports 218. Natural gas or propane may also be injected through the ports 219 to assest in the combustion process. The tubular member 212 acts as a vortex finder and thus a main vortical flow is generated within the cavity 214 and any contaminant matter in the resulting gases is sheared off from a boundary layer adjacent the wall of the body 202 into the chamber 222 wherein it is entrapped by the secondary vortex and precipitated in the chamber 222, there being no net gas flow between the cavity 214 and the chamber 222. Such matter is discharged through the base 225 as and when required by removal of the plate 227. The gaseous products of combustion exhaust through the tubular member 212 and into a flue (not shown) attached thereto. The flow within the cavity 214 is vortical from the inlets to the base end 203 and returns centrally back on itself to the outlet 208.

It has been found that by the use of this embodiment of combustor waste gas which would otherwise be discharged to atmosphere, can be burnt to provide a cleaner product by virtue of the fact that contaminants initially present are burnt out and any residual matter is captured within the catchment chamber.

In an alternative embodiment (not shown), the combustor of FIGS. 7 to 9 is horizontally orientated, the chamber 222 being removed and the wall being made continuous, a catchment chamber being applied to the outlet 208. Additionally, a further catchment chamber of the type described in our co-pending British Patent Application, No. 84/08920, may be applied to end of the body remote from outlet 208.

Referring now to FIGS. 10 to 13, there is shown a fourth embodiment of combustor 301 which comprises a cylindrical body 302 arranged vertically with a base end 303 supported on legs 305. The body 302 has a section 307 including a tubular part 309 having at least one tangential cooling air inlet port 318, the part 309 being disposed axially of the body 302 and fixed within the top end 311 thereof. An exhaust outlet 308 comprising a flanged tubular member 312 extends concentrically within the part 309 to define an annular passage 313 therebetween, spacers being provided to maintain the part 309 and member 312 in appropriate spaced relation.

A tangential feed stock inlet 304 is provided adjacent the top of the body 302 and communicates with an annular space 315 defined between the part 309 and body 302 which is refractory lined as at 317. Inlet ports (not shown) for air are arranged tangentially at the same level as inlet 304.

Figure 11:
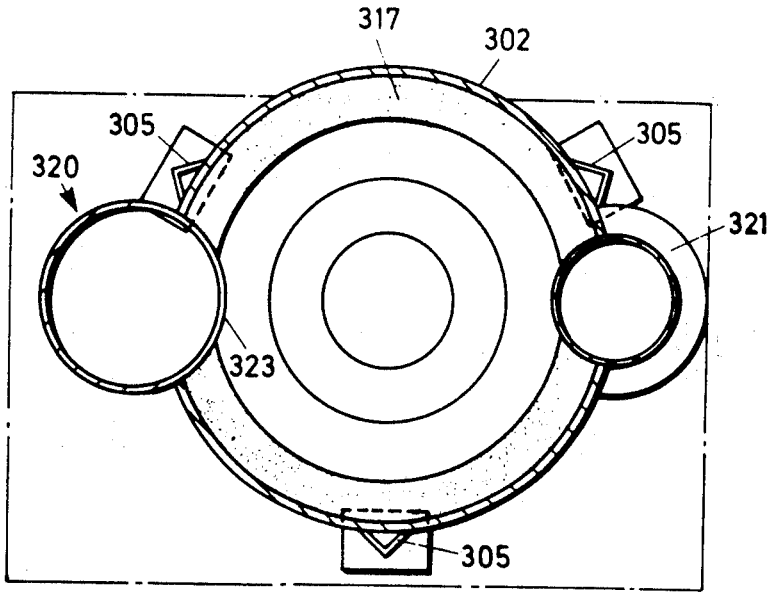
FIG. 11 is a cross-sectional view on the line XI—XI of FIG. 10.
Figure 12:
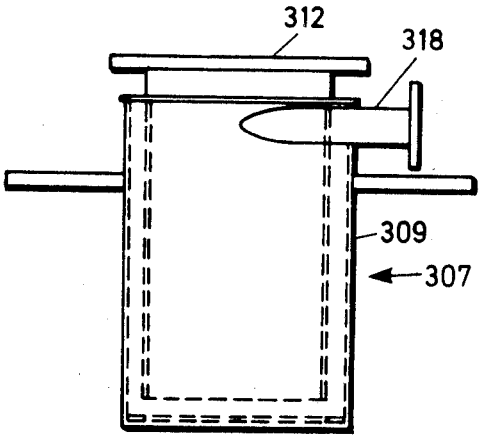
FIG. 12 is a side elevation of a detail shown in FIG. 10.
Figure 13:
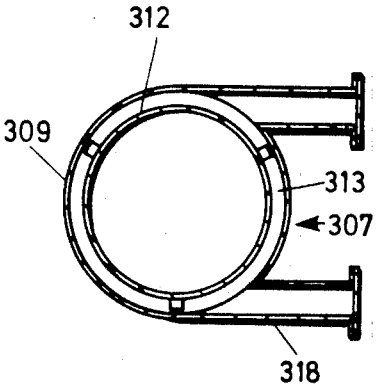
FIG. 13 is a sectional plan view on the line XIII—XIII of FIG. 12.

Further inlet ports 319 are provided lower down the body 302 for the introduction of other combustion promoting gas used in start-up. The body 302 has two catchment chambers 320, 321 each of cylindrical form with their axes arranged parallel to the axis of the body 302. Chamber 320 is relieved in its cylindrical wall whereby it overlaps and opens into the cavity 314 of the body 302 which is similarly relieved to provide a common boundary 323, the walls of the body and the chamber intersecting as shown in FIG. 11. The common boundary 323 extends for over half the length of the body 302. The wall of chamber 321 overlaps and opens into the body 302 in a similar manner to that as for chamber 320 and is disposed adjacent the base end 303, the chamber 321 being provided with a removable collection box 325.

The base end 303 has a central opening 327, the refractory lining 317 being correspondingly relieved to provide a passage 329 having a radiused shoulder 331. Connected to the opening 327 is a central catchment pot 333 which is bolted to the body 302.

In operation solid fuels or a waste gas, for example derived from a smokeless fuel production facility may be introduced through inlet 304 and air is supplied through the tangential inlet ports (not shown). Natural gas or propane is initially passed into the cavity 314 through the further inlet ports 319 in order to initiate combustion, thereafter the supply being discontinued. In this example, waste gas being introduced tangentially is caused to follow a vortical path, the part 309 acting a a vortex finder. The air and waste gas mix within the annular space 315 and follow a vortical path within the body 302 wherein the gas is burnt. Air is also passed through the inlet 318 for cooling purposes, this air exiting into the cavity 314 to provide secondary air for combustion. Contaminant matter, for example ash particles, is sheared off from the main vortex into the chambers 320, 321 and is entrapped in secondary vortices generated and driven within those chambers by means of the main vortex, there being no net gas flow into or out of the chambers. The matter so removed precipitates to the bases of the chambers 320, 321 for removal as and when desired or required.

The main vortex extends downwardly through the cavity 314 and enters the catchment pot 333 wherein vortical flow is also present. Any particles not captured within the chambers 320, 321 are precipitated within the pot 333, the vortex returning back on itself centrally into the body 302, the gases exhausting through the outlet 308. Any volatiles remining in the gases may be burnt at the point of exhaust to give a luminous flame. The fourth embodiment is thus advantageous in that it provides a number of catchment chambers for removing contaminants and also a central catchment pot for enhancing such removal.

In an alternative embodiment (not shown), the combustor of FIGS. 10 to 13, is orientated horizontally, the chambers 320, 321 being omitted. The inlet 304 is removed, one of the inlets 319 being used for the introduction of the feedstock. The feedstock inlet is then provided with an ejector which assists in balancing the pressure in the cavity 314.

The present invention affords a means of burning a variety of feedstocks and in this respect it is to be understood that whilst the various embodiments have been described with reference to solid and gaseous feedstocks, liquid feedstocks may also be used as indeed can combinations thereof, for example coal/water slurries. With the application of the present invention, feedstocks can be burnt and solid or other contaminant material ensuring from the combustion process can be removed from the gases prior to their egress from the combustor. The invention can therefore be employed for burning waste gas which may contain undesirable components whereby these components are extracted and thus are not discharged into the atmosphere. Furthermore, in solid fuel combustion equipment, particulate matter is usually entrained in the exhaust gases. Such matter generally contains some combustible material together with ash. By using the present invention this matter, in the form of grits, can be fired in the combustor and the grits removed prior to final atmospheric discharge of the gases. For example, the combustor of the present invention could be operated in conjunction with a fluidised bed combustor. The off gases would be passed directly into a section of the fluidised bed combustor formed of a combustor according to the present invention thereby to burn off the combustion gases and to remove elutriated bed material. Equally, the combustor of the present invention can be utilised as a hot gas generator to supply hot gas for the heat exchange elements in a boiler. Alternatively, the combustor of the present invention could be employed as a hot gas generator for supplying a clean hot gas for processes such as the firing of bricks in a kiln where ash deposits are undesirable. The use of the combustor for solid fuel firing would prevent the emission of undesirable particles into the body of the kiln.

The combustor of the present invention can be employed for burning coal/water mixtures.

We claim:

1. A combustor comprising a hollow circular sectioned body within which combustion is to take place in a vortical flow, the body having an inlet formed therein towards one end thereof for the introduction of a feedstock, an exhaust outlet in the body, wherein the invention comprises at least one port in the body for the entry of a combustion-promoting gas, the port being so disposed as to generate in use a vortical flow within the body, and a cylindrical catchment chamber the axis of which is arranged parallel to that of the body, the catchment chamber having its cylindrical wall relieved part circumferentially for intersection and registration with a correspondingly relieved portion of the body whereby in cross-section the walls of the body and the catchment chamber overlap in the manner of intersecting circles to provide a common boundary, in use a secondary vortex being established in the chamber and contaminant matter arising from the combustion of the feedstock passing from the body into the catchment chamber and precipitating therein for removal therefrom.

2. A combustor comprising a hollow circular sectioned body within which combustion is to take place in a vortical flow, the body having an inlet formed therein towards one end thereof for the introduction of a feedstock, an exhaust outlet in the body, wherein the invention comprises at least one port in the body for the entry of a combustion-promoting gas, the port being so disposed as to generate in use vortical flow within the body, and a catchment chamber of curvilinear form with a part-circular portion leading to a rectilinear portion, the part-circular portion being relieved to provide an opening for overlapping registration with a complementary opening in the wall of the body, whereby in use a secondary vortex is established in the catchment chamber, and contaminant matter arising from the combustion of the feedstock passes from the body into the catchment chamber and precipitates therein for removal therefrom.

3. A combustor according to claim 2 in which the secondary vortex is established in the chamber in the absence of any net gas flow between the body and the chamber.

4. A combustor according to claim 2 in which the body is cylindrical.

5. A combustor according to claim 4 in which the feedstock inlet is arranged tangentially in relation to the body.

6. A combustor according to claim 2 in which the exhaust outlet is arranged on the axis of the body.

7. A combustor according to claim 6 in which the exhaust outlet is formed of a tubular member protruding into the body through one end thereof.

8. A combustor according to claim 2 in which the exhaust outlet is located at the end of the body remote from the feedstock inlet.

9. A combustor according to claim 2 in which the exhaust outlet is disposed adjacent the feedstock inlet.

10. A combustor according to claim 9 in which the exhaust gas outlet is formed of a tubular member protruding into the body through one end thereof to define an annular passage between the member and the body, the feedstock inlet communicating with the annular passage.

11. A combustor according to claim 2 in which a plurality of ports is provided, the ports being arranged tangentially of the body.

12. A combustor according to claim 11 in which each port is angularly orientated towards one end of the body.

13. A combustor according to claim 12 in which each port is angularly orientated towards the feedstock inlet.

14. A combustor according to claim 2 in which the catchment chamber is of circular section.

15. A combustor according to claim 2 in which the catchment chamber is located near the exhaust outlet.

16. A combustor according to claim 2 in which the catchment chamber is located remote from the exhaust outlet.

17. A combustor according to claim 2 in which more than one catchment chamber is provided, the chambers being spaced apart along the length of the body.

18. A combustor according to claim 2 in which a further catchment chamber is arranged in association with the exhaust outlet of the body.

19. A combustor according to claim 18 in which the exhaust outlet is formed of a tubular member and the further catchment chamber intersects and opens into the tubular member.

20. A combustor according to claim 18 in which the further catchment chamber has a common bounding wall with the catchment chamber associated with the body.

21. A combustor according to claim 2 in which the catchment chamber has a receptacle for contaminants.

22. A combustor according to claim 2 in which the catchment chamber has a discharge means.

23. A combustor according to claim 22 in which the discharge means is a worm extractor.

24. A combustor according to claim 2 in which the body is refractory 20 lined.

25. A combustor according to claim 2 in which the body is provided with a cooling jacket.

26. A combustor according to claim 2 in which the body is in use arranged horizontally.

27. A combustor according to claim 2 in which the body is in use arranged vertically.

28. A combustor according to claim 2 in which the body has a base provided with a central opening communicating with a catchment pot located externally of the body.

29. A combustor according to claim 28 in which the catchment pot is of cylindrical form with a closed end remote from the opening.

30. A combustor according to claim 1, in which the secondary vortex is established in the chamber in the absence of any net gas flow between the body and the chamber.

31. A combustor according to claim 1, in which the body is cylindrical.

32. A combustor according to claim 31, in which the feedstock inlet is arranged tangentially in relation to the body.

33. A combustor according to claim 1, in which the exhaust outlet is arranged on the axis of the body.

34. A combustor according to claim 3, in which the exhaust outlet is formed of a tubular member protruding into the body through one end thereof.

35. A combustor according to claim 1, in which the exhaust outlet is located at the end of the body remote from the feedstock inlet.

36. A combustor according to claim 1, in which the exhaust outlet is disposed adjacent the feedstock inlet.

37. A combustor according to claim 36, in which the exhaust gas outlet is formed of a tubular member protruding into the body through one end thereof to define an annular passage between the member and the body, the feedstock inlet communicating with the annular passage.

38. A combustor according to claim 1, in which a plurality of ports is provided, the ports being arranged tangentially of the body.

39. A combustor according to claim 38, in which each port is angularly orientated towards one end of the body.

40. A combustor according to claim 9, in which each port is angularly orientated towards the feedstock inlet.

41. A combustor according to claim 1, in which the catchment chamber is of circular section.

42. A combustor according to claim 1, in which the catchment chamber is located near the exhaust outlet.

43. A combustor according to claim 1, in which the catchment chamber is located remote from the exhaust outlet.

44. A combustor according to claim 1 in which more than one catchment chamber is provided, the chambers being spaced apart along the length of the body.

45. A combustor according to claim 1, in which a further catchment chamber is arranged in association with the exhaust outlet of the body.

46. A combustor according to claim 45, in which the exhaust outlet is formed of a tubular member and the further catchment chamber intersects and opens into the tubular member.

47. A combustor according to claim 45, in which the further catchment chamber has a common bounding wall with the catchment chamber associated with the body.

48. A combustor according to claim 1, in which the catchment chamber has a receptacle for contaminants.

49. A combustor according to claim 1, in which the catchment chamber has a discharge means.

50. A combustor according to claim 49, in which the discharge means is a worm extractor.

51. A combustor according to claim 1, in which the body is refractory lined.

52. A combustor according to claim 1, in which the body is provided with a cooling jacket.

53. A combustor according to claim 1, in which the body is in use arranged horizontally.

54. A combustor according to claim 1, in which the body is in use arranged vertically.

55. A combustor according to claim 1, in which the body has a base provided with a central opening communicating with a catchment pot located externally of the body.

56. A combustor according to claim 55, in which the catchment pot is of cylindrical form with a closed end remote from the opening.

* * * * *